US006357590B1

(12) United States Patent
Karpisek

(10) Patent No.: US 6,357,590 B1
(45) Date of Patent: Mar. 19, 2002

(54) CONTAINER BASE WITH A FLOOR PANEL TILTING MEANS

(76) Inventor: Ladislav Stephan Karpisek, 86 Woodfield Boulevarde, Caringbah, New South Wales 2229 (AU)

( * ) Notice: Subject to any disclaimer, the term of this patent is extended or adjusted under 35 U.S.C. 154(b) by 0 days.

(21) Appl. No.: 09/529,361

(22) PCT Filed: Sep. 8, 1998

(86) PCT No.: PCT/AU98/00729

§ 371 Date: Apr. 10, 2000

§ 102(e) Date: Apr. 10, 2000

(87) PCT Pub. No.: WO99/20539

PCT Pub. Date: Apr. 29, 1999

(30) Foreign Application Priority Data

Oct. 16, 1997 (AU) ..... PO 9858

(51) Int. Cl.[7] ..... B65D 19/00

(52) U.S. Cl. ..... 206/386; 248/346.05

(58) Field of Search ..... 248/346.05, 346.06, 248/371, 372.1, 398, 139, 346.02; 108/57.1; 206/386; 414/417, 419; 222/77, 164, 166, 185.1

(56) References Cited

U.S. PATENT DOCUMENTS 533,687 A * 2/1895 Walker ..... 248/133

3,166,218 A * 1/1965 Paintin ..... 222/56

FOREIGN PATENT DOCUMENTS

| | | | |
|---|---|---|---|
| EP | 0134095 A1 | * | 3/1985 |
| EP | 0361696 A1 | * | 4/1990 |
| GB | 2137159 A | * | 10/1984 |
| GB | 2211480 A | * | 7/1989 |
| GB | 2271550 A | * | 4/1994 |
| GB | 2296701 A | * | 10/1996 |
| GB | 2300175 A | * | 10/1996 |

* cited by examiner

*Primary Examiner*—Ramon O. Ramirez
*Assistant Examiner*—Holly N. Sy
(74) *Attorney, Agent, or Firm*—Edwin D. Schindler

(57) ABSTRACT

A rectangular container base for a container for supporting a plastic liner bag for housing a liquid, includes a side panel coupling device on the container base so that four interconnectable side panels are able to be erected on the container base, respectively, adjacent edges of the base. A support panel tilting element, housed in the container base for tilting a liner bag support panel when overlying the container base, is included, and a support panel tilting device is provided with a floor panel lifter disposed adjacent one edge of the rectangular container base. The floor panel lifter has an operative position above an upper face of the container base and an inoperative position below the upper face. A resilient floor panel lifter biassing device urges the floor panel lifter to the operative position, with a floor panel lifter retaining device, for releasably retaining the floor panel lifter in the inoperative position against an action of the resilient floor panel lifter biassing device being provided.

12 Claims, 4 Drawing Sheets

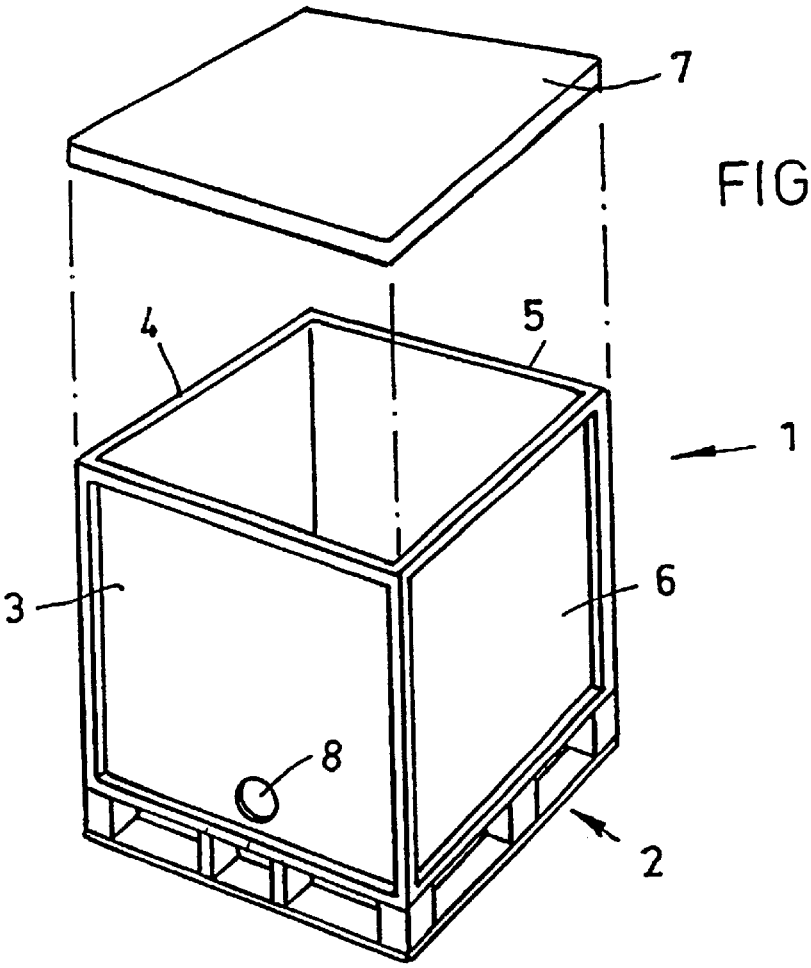
FIG. 1.
FIG. 2.
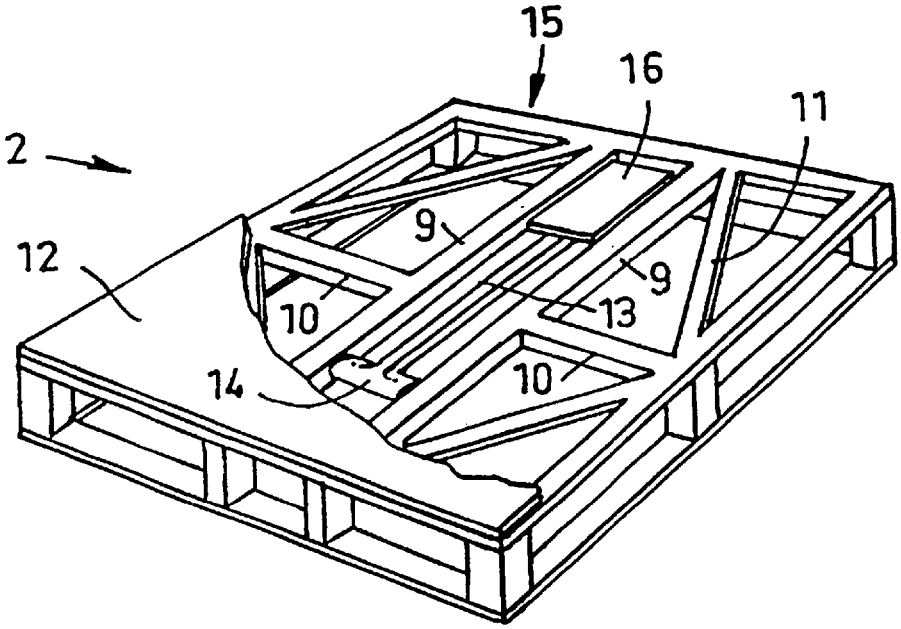

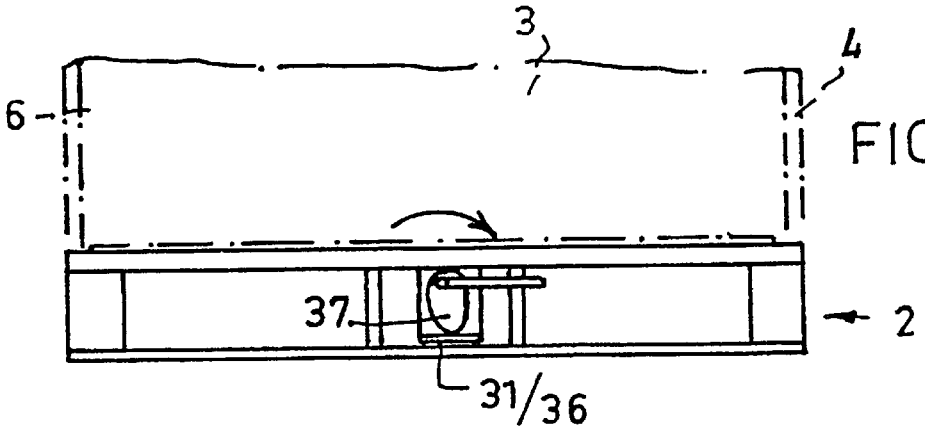
FIG. 8.
FIG. 9.
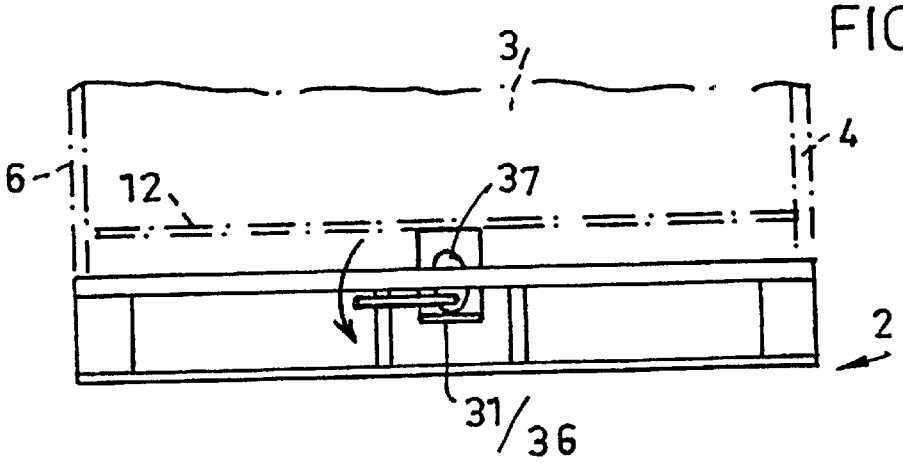

CONTAINER BASE WITH A FLOOR PANEL TILTING MEANS

FIELD OF THE INVENTION

This invention is concerned generally with emptying liquid from a container.

BACKGROUND TO THE INVENTION

A typical form of container for the storage and transport of liquid is one in which there is a pallet type base on which there is mounted four interlocked sides. The sides can be demountable from the base or can be hinged thereto so that the sides can fold down over the base. The base and the sides when erected on the base provide an open topped enclosure for a plastic film liner bag. A lid is provided for the open top of the container. Discharge is usually by gravity through a nozzle of the liner bag which projects through an opening in one side of the container adjacent the base of the container. The nozzle is adapted for the connection of a valve and the PC a discharge pipe.

The problem with such containers is that the construction of the container sides places the nozzle above the floor of the container and some liquid remains in the container after gravity discharge through the nozzle ceases. This can be overcome to some extent by tilting the container towards the container side having the nozzle opening. This involves equipment capable of tilting the container and means to lift the container onto and off the tilter. The cost of a tilting device and the container handling means makes this solution to the problem unattractive. Even with a tilting device there is usually a small amount of liquid, which in the case of valuable liquids can represent an unacceptable economic loss, which remains to be recovered. in order to recover the maximum amount of liquid the liner bag is often manhandled when nearly empty so as to direct substantially all of the liquid in the bag towards the bag nozzle. This approach is commercially unacceptable because of the cost of the labor involved and because it is not a satisfactory long term solution to the problem.

The present invention has as its object the provision of container base which will by a combination of features simply and effectively achieve substantially complete gravity discharge of liquid from containers of the above known type referred to above.

BRIEF SUMMARY OF THE INVENTION

Broadly stated, the present invention provides a container base including tilting means for a base covering panel.

More specifically, the present invention provides a container base including tilting means for a base covering panel wherein the tilting means is resiliently biassed away from an inoperative position towards an operative position in which it will tilt a base covering panel.

Preferred embodiments of the invention will now be described with reference to the accompanying drawings.

BRIEF DESCRIPTION OF THE DRAWINGS

FIG. 1 is a schematic perspective view of a container of the type with which the base of the present invention is proposed to be used, FIG. 2 is a detailed perspective view of one form of container base according to the present invention covered in part by a floor sheet, the missing portion of the floor sheet facilitates the following description of the base, FIG. 8 is a schematic end view of the base cover sheet tilter latched in the inoperative position by cam means, and FIG. 9 is a view similar to FIG. 8 showing the base cover sheet tilter released by the cam means of FIG. 8 and the tilter in the unlatched operative position shown in FIG. 6.

Figure 3:
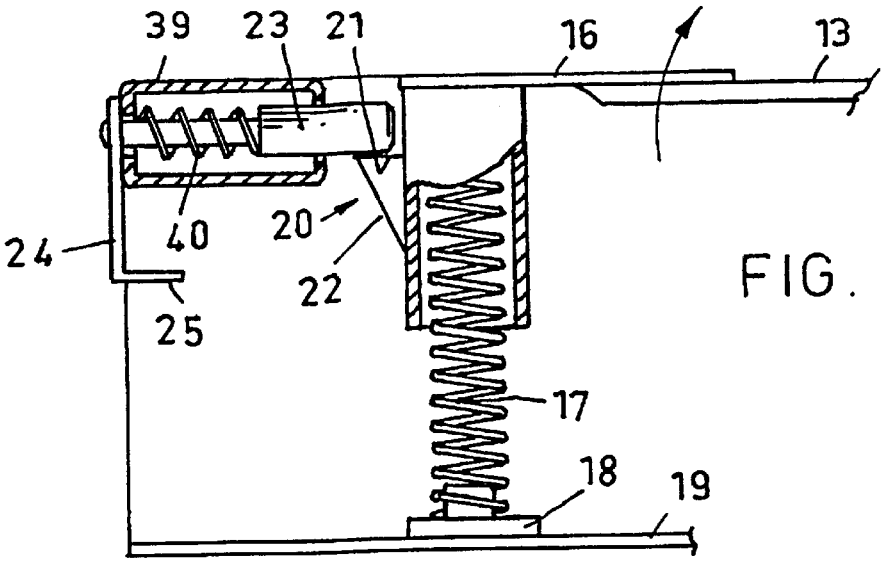
FIG. 3 is a detailed partly sectioned fragmentary view of one arrangement for holding the floor sheet tilting means of the base of FIG. 2 in the latched down inoperative position.

DETAILED DESCRIPTION OF THE INVENTION.

The container 1 of FIG. 1 includes a four-way entry pallet type base 2 with upstanding side panels 3,4,5,6. The side panels can be permanently mounted in an upstanding manner on the base 2, or they can be hingedly mounted at the four sides of the base allowing the side panels to fold down one over the other over the base, or they can be demountably coupled to the base at the four sides of the base. The side panel to base connection is not relevant to the present invention. A lid 7 for the container is also shown in FIG. 1. The side panel 3 is shown having an opening 8 to allow a discharge nozzle of a plastic film liner bag in the container to project. The liner bag in the container would be filled with a liquid.

In FIG. 2 the base 2 is shown as a four sided skeletal structure with a pair of first lateral members 9 and lateral members 10 at right angles to the members 9 and intermediate angled members 11. Overlying the base 2 there is a cover sheet 12 to provide a support surface for a plastic film liner bag to be housed in the container.

A base cover sheet tilter is provided and it includes an arm 13 which is pivotally mounted at one end at 14 to the lateral members 9 at a position remote from the first side 15 of the base 2. The arm extends towards the first base side 15 and a pressure plate 16 is fixed to the arm 13 at the arm end adjacent the base first side 15.

Referring now to detail drawing FIG. 3, there is a compression spring socket member fixed to the under face of the plate 16 and a compression spring 17 is housed in part in the socket member with its upper end abutting the plate 16 and its lower end engaged over a spigot 18 fixed to a ground engaging member 19 of the base 2. Projecting from the spring socket member there is a lug 20 with an upper abutment face 21.

Slidably mounted in a tubular upper base member 39 at the first side 15 of the base 2 there is a plunger 23 which is spring loaded by spring 40 to a position where the inner free end of the plunger 23 lies in the path of the lug 20 of the plate 16 thereby preventing movement of the base cover sheet tilter from the lowered inoperative position to the raised operative position thereof. The spring 17 urges the abutment face 21 of the lug 20 against the plunger 23. The under face of the lug 20 includes a cam face 22. It will be readily understood that in order to return the tilter arm 13 to the latched position it only requires a downward force on the plate 16 to the extent that the cam face 22 will cause the plunger 23 to retract. As soon as the lug abutment face 21 passes to an elevation below the plunger 23 the plunger will move to the extended position under the influence of the spring 40. The plate 16 when released will move upward under the influence of the spring 17 to a position where the abutment face 21 of the lug 20 bears on the lunger 23. To facilitate the manual retraction of the plunger 23 a hand grip 24 is provided. It is to be noted that the handgrip 24 has a tail 25 for a reason to be described.

Figure 4:
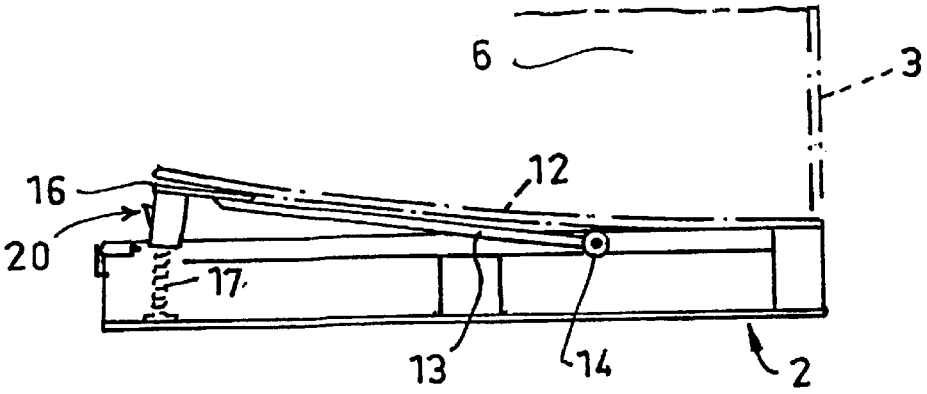
FIG. 4 is a schematic side view illustrating the manner in which the floor sheet will be tiled by the tilting means of FIG. 3.

As will be seen from the schematic view FIG. 4 the base tilter arm 14 when raised causes the base floor sheet 12 (shown in broken lines) to be tilted and slope towards the base edge at which the container side 3 (with the nozzle hole 8) is mounted. The strength of the spring 17 used to raise the base floor sheet need not be great. The invention is concerned with the recovery of the small amount liquid which would be trapped in the liner bag due to the height of the nozzle above the base floor sheet. It is therefore not necessary to raise and tilt the base floor sheet until most of the liquid in the liner bag resting on the base floor sheet has been discharged. It follows that when an operator notes that the liquid has ceased to gravity discharge from the nozzle the operator could withdraw the plunger 23 to allow the base floor sheet tilter to come into play to direct the last of the liquid in the liner bag towards the nozzle in the opening 8.

Figure 5:
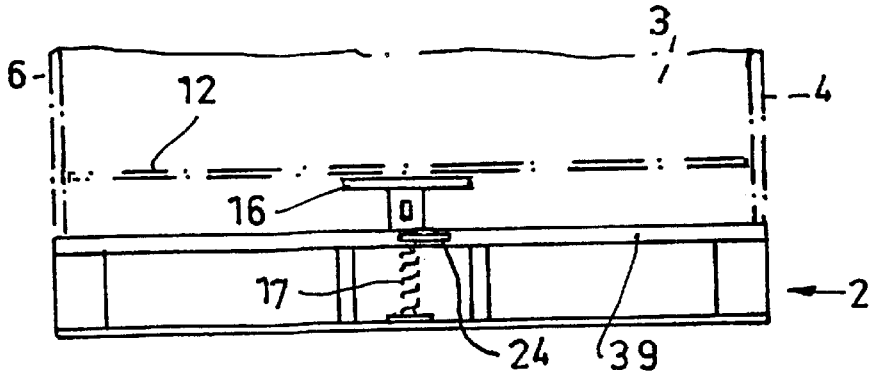
FIG. 5 is a schematic end view of the base as illustrated in FIG. 4.

In order to allow complete emptying of the liner bag without the need for operator monitoring of the liquid flow from the container the handle 24 on the plunger 23 is provided with the tail 25. At the commencement of a container emptying cycle the operator would draw back the plunger 23, turn the plunger 23 to align the tail 25 with the base member 39 (see FIG. 5) and allow the spring 40 to draw the tail 25 into contact with the member 39 The plunger 23 is thereby held retracted. The operator can then walk away knowing that when sufficient liquid has been discharged from the liner bag the base cover sheet will be tilted automatically to direct liquid to the nozzle.

Figure 6:
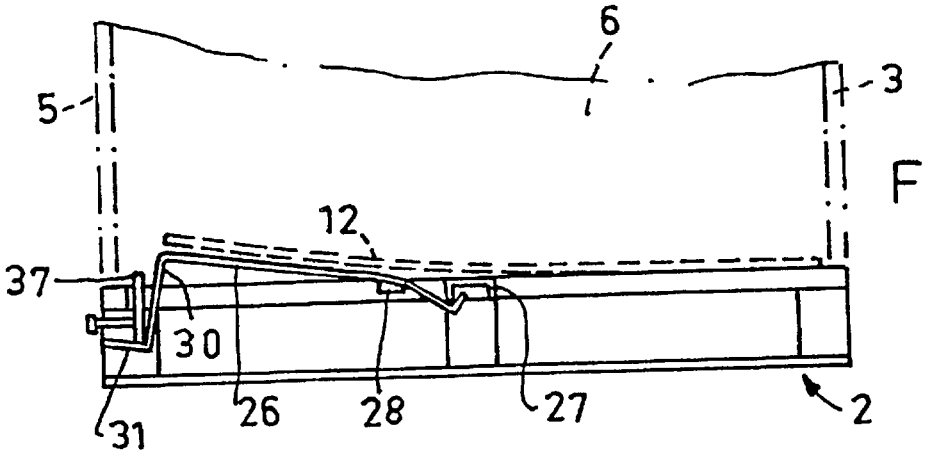
FIG. 6 illustrates another form of base cover sheet tilter in the unlatched operative condition with a base cover sheet tilted.

Referring now to schematic views FIGS. 6 to 9 showing alternative arrangements to the plunger arrangement illustrated in FIG. 3. FIG. 6 illustrates a leaf spring 26 in a floor cover sheet tilting condition. The spring 26 adjacent one end bears on a support bar 28 of the base 2 and at that end is hooked under another bar 27 of the base 2. The other end of the leaf spring is provided with a leg 30 which extends towards the base 2 and terminates with a foot 31. Force applied to the foot 31 will cause the leaf spring 26 to be deflected and energy is stored in the spring as a result. The spring can be latched in the deflected condition in several ways one of which could be a variation of the plunger 23 arrangement just described or by way of a cam, to be described later.

Figure 7:
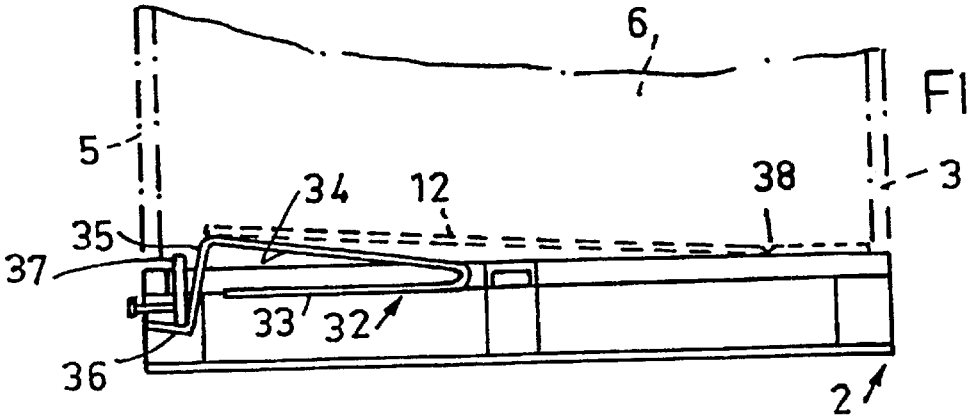
FIG. 7 illustrates a variation of the cover sheet tilter of FIG. 6 in the unlatched operative condition with a base cover sheet tilted.

FIG. 7 illustrates a variation of the leaf spring arrangement of FIG. 6. In FIG. 7 the leaf spring 32 has a Vee shaped body with a limb 33 fixed to the base and an upwardly outwardly angled limb 34, as has the spring 26. The spring limb 34 has a leg 35 and a foot 36, as has the leaf spring 26.

In FIGS. 6 to 9 there is illustrated a cam 37 which can be rotated between the orientation of FIG. 8 and FIG. 9. In FIG. 8 the cam lobe holds the foot (31,36) depressed thereby latching the leaf spring in the inoperative position. In FIG. 9, the cam has been rotated 180 degrees and the cam lobe no longer holds the leaf spring depressed and the leaf spring is in the unlatched and base cover sheet tilting condition, as illustrated in FIGS. 6 and 7.

It is to be noted that the base cover sheet 12 in FIGS. 4 and 6 is shown as curved along the majority of its length whereas the base cover sheet 12 is shown in FIG. 7 as bending at a specific position indicated 38. At the position 38 there is a lateral crease or reduced thickness zone of the sheet 12 thereby predisposing the sheet to fold at that position. The result is a tilt of a major portion of the base covering sheet 12. As will be understood the material from which the sheet 12 is made will be a factor in deciding whether the sheet 12 is to bend as a curve (FIGS. 4 and 6) or sharply (FIG. 7).

Latching means to latch the base covering sheet tilter in the inoperative position has been described in detail above. It is to be understood that the invention is not limited to the base having latching means as specifically described and illustrated and is not limited to the base having latching means for the base covering sheet tilter.

What is claimed is:

1. A container having a rectangular container base for supporting a plastic liner bag for housing a liquid, comprising:

side panel coupling means on said rectangular container base so that four interconnectable side panels are capable of being erected on said rectangular container base, respectively, adjacent edges of said rectangular container base;

support panel tilting means housed in said rectangular container base for tilting a liner bag support panel when overlying said rectangular container base, said support panel tilting means including a floor panel lifter disposed adjacent one edge of said rectangular container base, said floor panel lifter having an operative position above an upper face of said rectangular container base and an inoperative position below said upper face;

resilient floor panel lifter biassing means for urging said floor panel lifter to the operative position; and, floor panel lifter retaining means for releasably retaining said floor panel lifter in the inoperative position against an action of said resilient floor panel lifter biassing means.

2. The container according to claim 1, wherein said resilient floor panel lifter biassing means is a spring in which energy is stored by deflection of said spring as said floor panel lifter is moved from said operative position to said inoperative position.

3. The container according to claim 2, wherein said resilient floor panel lifter biassing means is a leaf spring.

4. The container according to claim 2, wherein said floor panel lifter is a body part of a leaf spring anchored to said rectangular container base, said leaf spring body part extending from adjacent a central area of said rectangular container base upwardly at an angle from said rectangular container base when said floor panel lifter is in said operative position and extends outwardly to adjacent said one edge of said rectangular container base where said leaf spring body part terminates in a leg extending towards said rectangular container base, a foot on said body part of said leaf spring being engagable with a part of said rectangular container base for limiting an angle at which said body part of said leaf spring is able to lie relative to said rectangular container base when said floor panel lifter is in said operative position.

5. The container according to claim 4, further comprising a cam mounted on said rectangular container base and rotatable about an axis at right angles to said one edge of said rectangular container base, said cam being in engagement with said foot of said body part of said leaf spring and having a profile, so that when said cam is rotated in a first direction, said floor panel lifter is movable from said inoperative position towards said operative position, said cam when moved in an opposite direction moves said floor panel lifter to said inoperative position.

6. The container according to claim 1, wherein said floor panel lifter is part of an arm pivotally connected to said rectangular container base at a location remote from said one edge of said rectangular container base and extending from the location of the pivotal connection of said arm to said rectangular container base to adjacent said one edge of said rectangular container base, with said resilient floor panel lifter biassing means being disposed between said arm and said rectangular container base.

7. The container according to claim 6, wherein said resilient floor panel lifter biassing means is a compression spring in which energy is stored via deflection of said compression spring as said floor panel lifter moves from said operative position to said inoperative position.

8. The container according to claim 7, further comprising a plunger mounted on said rectangular container base and linearly movable between a latching position for latching said floor panel lifter in said inoperative position and an unlatching position, said plunger being biassed to said latching position, wherein said plunger lies in a path of travel of an abutment face of said arm a lug for prevent-said floor panel lifter from adopting said operative position.

9. The container according to claim 8, wherein said abutment face is on said lug on a spring socket on said arm housing part of said compression spring.

10. The container according to claim 9, wherein said lug has a cam face for causing said plunger to move linearly away from said latching position as said floor panel lifter is manually returned to said inoperative position from said operative position for placing said abutment face of said lug below said plunger.

11. The container according to claim 9, further comprising plunger retaining means for releasably retaining said plunger out of said latching position.

12. The container according to claim 6, further comprising a cam mounted on said rectangular container base and rotatable about an axis at right angles to the axis of a pivotal connection of said arm to said base, said cam being in engagement with an abutment face of a lug on a presser plate attached to said arm and having a profile so that when said cam is rotated in a first direction, said floor panel lifter is movable from said inoperative position towards said operative position, said cam when moved in an opposite direction moves said arm for placing said floor panel lifter in said inoperative position.

* * * * *